US007458120B2

(12) United States Patent
Chang et al.

(10) Patent No.: US 7,458,120 B2
(45) Date of Patent: Dec. 2, 2008

(54) INFLATABLE ITEM WITH A VALVE ATTACHED THERETO

(76) Inventors: Hsien-Wen Chang, P.O. Box 44 - 2049, Taipei (TW) 10668; Simon Yu, P.O. Box 44 - 2049, Taipei (TW) 10668

( * ) Notice: Subject to any disclaimer, the term of this patent is extended or adjusted under 35 U.S.C. 154(b) by 204 days.

(21) Appl. No.: 11/507,133

(22) Filed: Aug. 22, 2006

(65) Prior Publication Data

US 2008/0047072 A1 Feb. 28, 2008

(51) Int. Cl.
*A47C 27/08* (2006.01)

(52) U.S. Cl. ..... 5/708; 5/706; 417/313

(58) Field of Classification Search ..... 5/706, 5/708, 655.3, 710; 417/313
See application file for complete search history.

(56) References Cited

U.S. PATENT DOCUMENTS 3,112,502 A * 12/1963 Forsberg ..... 5/708
3,133,696 A * 5/1964 Mirando ..... 417/479
3,155,991 A * 11/1964 Dunham ..... 5/708
3,583,008 A * 6/1971 Edwards ..... 5/655.3
5,632,055 A * 5/1997 Graf ..... 5/706
6,185,770 B1 * 2/2001 Wang ..... 5/706

* cited by examiner

*Primary Examiner*—Alexander Grosz

(57) ABSTRACT

An inflatable item includes a hollow body and a valve is connected to the hollow body. The valve is a bladder which has an inlet from which air is introduced in the bladder, and an outlet through which the air is introduced into the hollow body. A tubular insertion is engaged with the inlet and has a passage defined therethrough. A bouncing member is mounted to the tubular insertion so that the user compresses the bladder to push the air in the bladder into the hollow body and the bouncing member bounces the bladder back to original status. The hollow body can be inflated by repeatedly compressing the bladder. A cap removably seals the inlet after the inflatable item is inflated.

4 Claims, 7 Drawing Sheets

INFLATABLE ITEM WITH A VALVE ATTACHED THERETO

BACKGROUND OF THE INVENTION (1) Field of the Invention

The present invention relates to a valve attached with the inflatable item and the valve includes a bouncing member such that the user may push the valve repeatedly to inflate the item.

(2) Description of the Prior Art

Conventional inflatable items such as inflatable life rings, sofas, boats and beds are made by soft material and include a valve which allows air to be introduced into the inflatable items so as to inflate the items. The valve can cooperate with a pumping device which can be an electric pump or manual-operation pump. Nevertheless, the electric pumping device has to be powered by AC power which cannot be found in outdoor sites. If the users forget to carry the pumping device, then the inflatable items cannot be inflated easily. Besides, the pumping device requires extra space to be stored and carried.

The present invention intends to provide an inflatable item with a valve which includes a bouncing member receiving therein so that the user can push the bouncing member repeatedly to introduce air into the inflatable item without need of extra tools.

SUMMARY OF THE INVENTION

The present invention relates to an inflatable item which is a hollow body made by flexible material and a valve is connected to the body so as to introduce air into the hollow body. The valve has a bladder which has an inlet and an outlet. A tubular insertion is engaged with the inlet and has a passage defined therethrough. A bouncing member is mounted to the insertion so as to bounce the bladder back to original status after the bladder is compressed. A seal member is pivotably connected to the insertion so as to prevent the air in the bladder from escaping from the bladder via the inlet. A cap removably seals the inlet.

The primary object of the present invention is to provide an inflatable item which has a valve connected thereto which can be operated without any pumping device.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENTS

Figure 1:
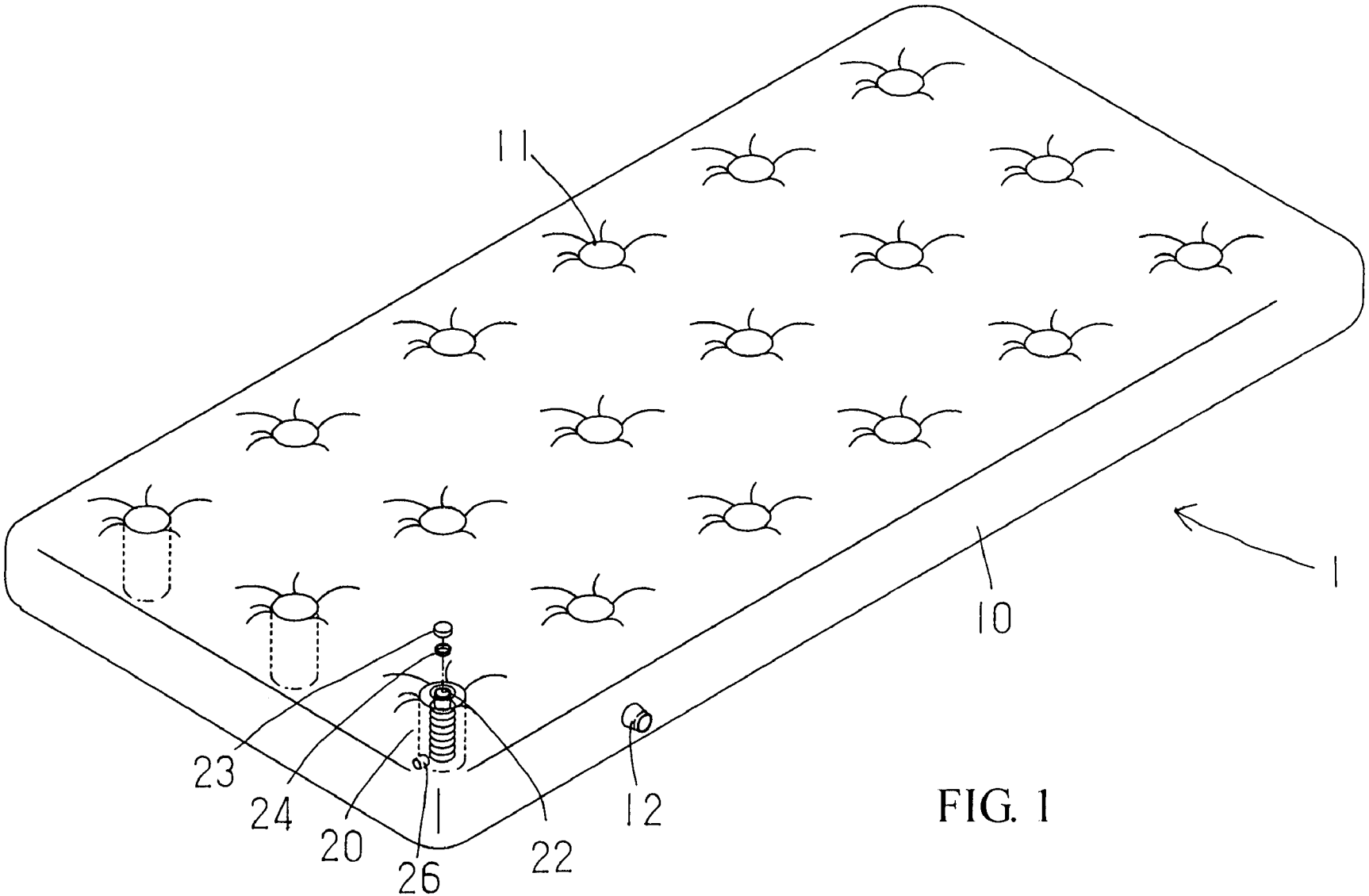
FIG. 1 is a perspective view to show the inflatable item of the present invention.
Figure 2:
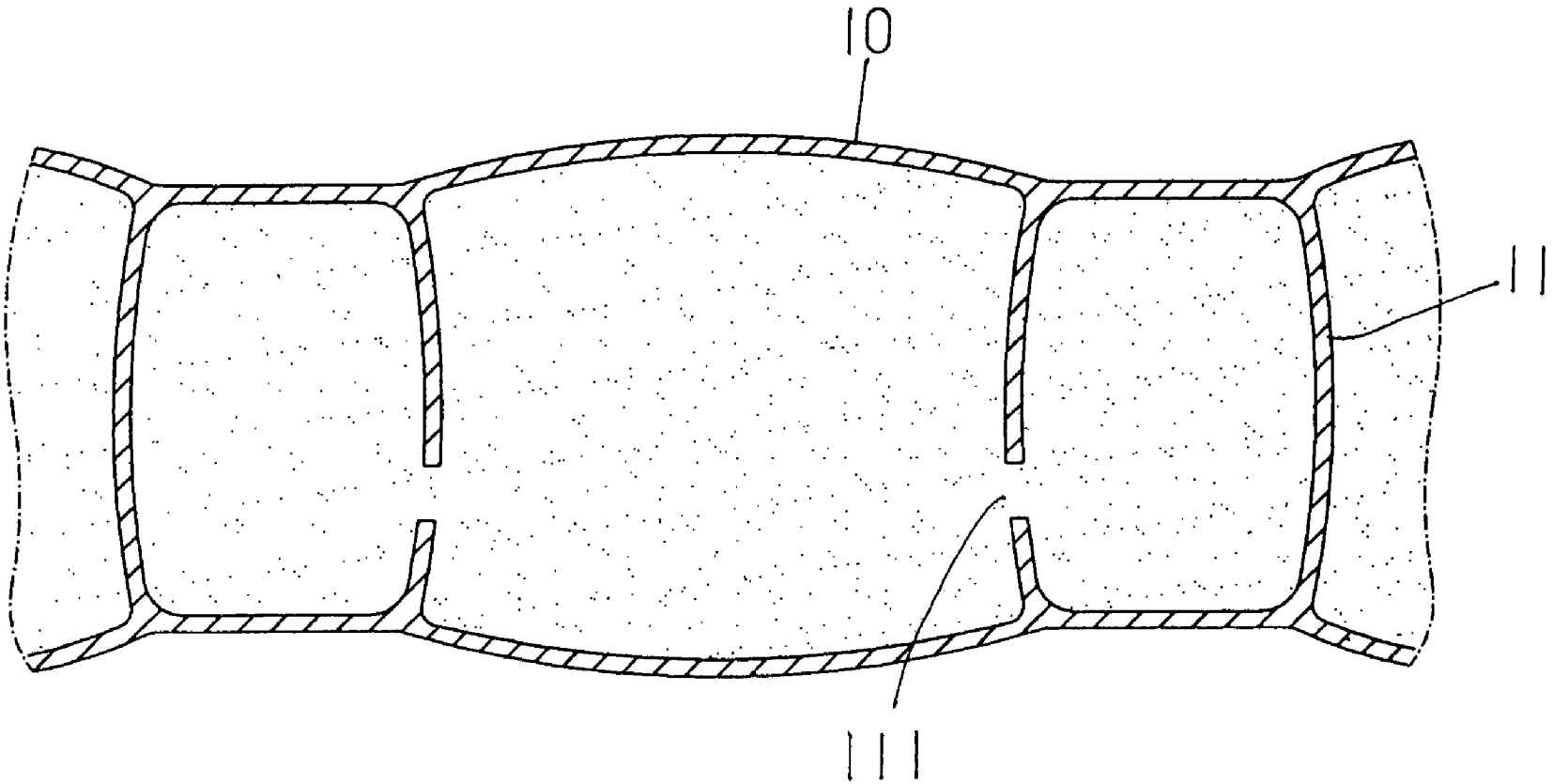
FIG. 2 is a cross sectional view to show ribs extending from opposite insides of the hollow body of the inflatable item.
Figure 3B:
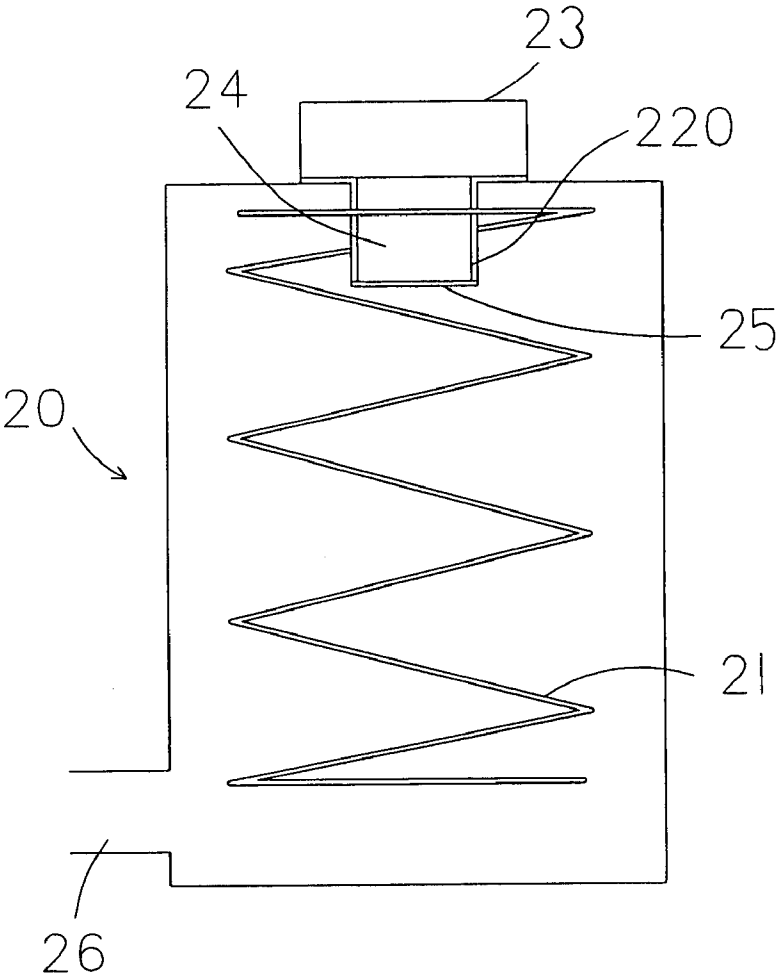
FIG. 3B shows that the cap is engaged with and seals the inlet of the valve.
Figure 3A:
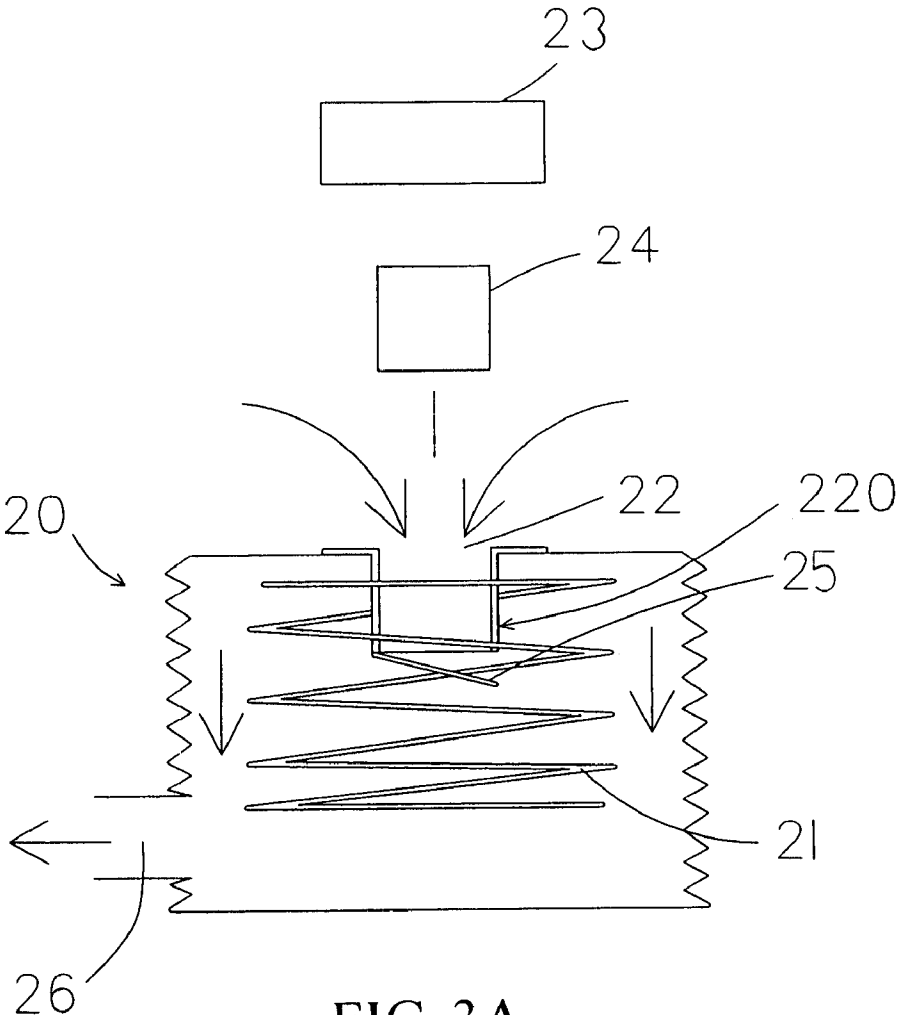
FIG. 3A shows the cap is removed from the inlet and air is introduced into the bladder.
Figure 4B:
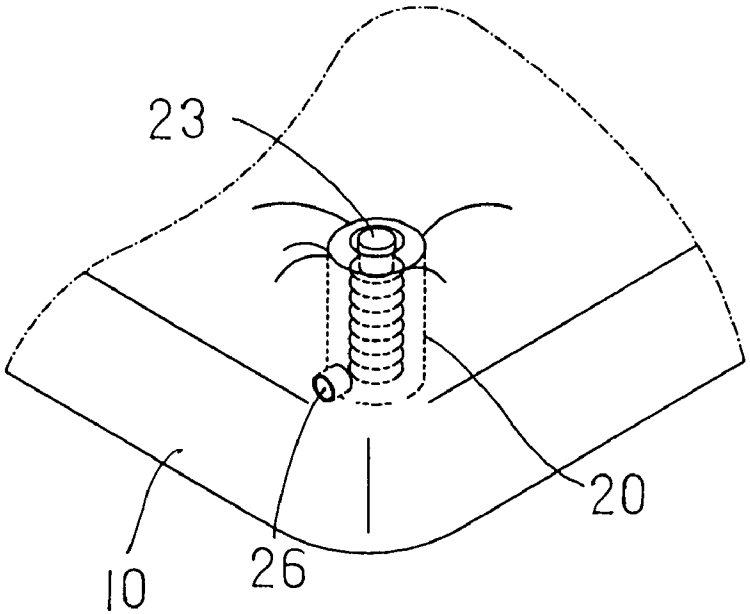
FIG. 4B shows that the cap is engaged with and seals the inlet of the valve in the hollow body.
Figure 4A:
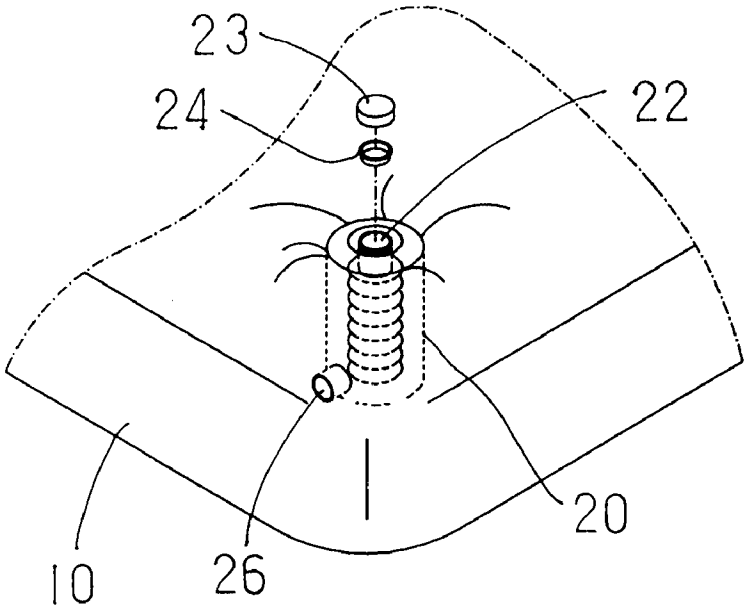
FIG. 4A is an exploded view to show the cap and the valve in the hollow body.

Referring to FIGS. 1, 2, 3A, 3B, 4A and 4B, the inflatable item 1 of the present invention comprises a hollow body 10 made by flexible material such as thermoplastic polyurethane (TPU) and a valve 20 is connected to the hollow body 10. The valve 20 has a bladder which has an inlet 22 from which air is introduced into the bladder, and an outlet 26 via which the air in the bladder is introduced into the hollow body 10. A tubular insertion 220 is engaged with the inlet 22 and has a passage defined therethrough. A bouncing member 21 such as a spring is mounted to the tubular insertion 220. A seal member 25 is pivotably connected to the tubular insertion 220 and pivotable between an open position to open the passage of the tubular insertion 220 and a closed position to seal the passage of the tubular insertion 220. By the seal member 25, the air in the bladder cannot escape from the bladder via the inlet 22. A cap is removably sealing the inlet 22 and composed of a seal 24 which can be engaged with the inlet 22 and a cover 23 which is exposed on outside of the hollow body 10 and accessible by the users.

The bladder is compressible so that the user simply repeatedly compresses the bladder by his or her foot, when the bladder is compressed, the air in the bladder enters into the hollow body 10, and then the bouncing member 21 bounces the bladder back to original status for the next compression action. Therefore, the inflatable item can be inflated efficiently and manually without using any extra tool such as pumping device.

The hollow body 10 includes a plurality of ribs 11 extending from two opposite sides thereof and a gap 111 is defined between the ribs 11 on the inside of the hollow body 10 so that air can be filled within the whole interior of the hollow body 10. After the hollow body 10 is inflated, the cap securely seals the inlet 22. A release valve 12 is connected to the hollow body 10 and air can be released through the release valve 12 after use.

Figure 5:
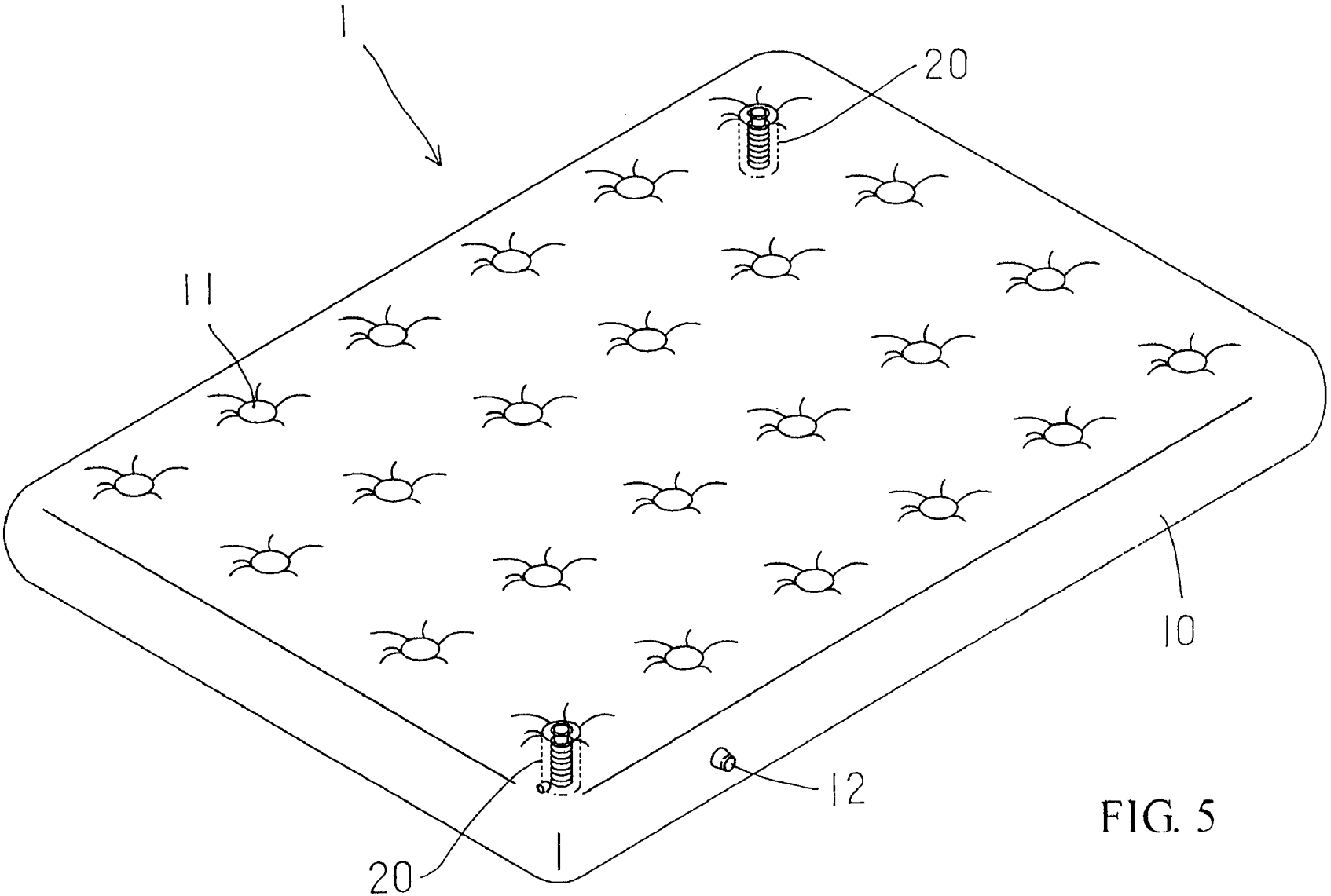
FIG. 5 shows that the hollow body has two valves connected thereto.
Figure 6:
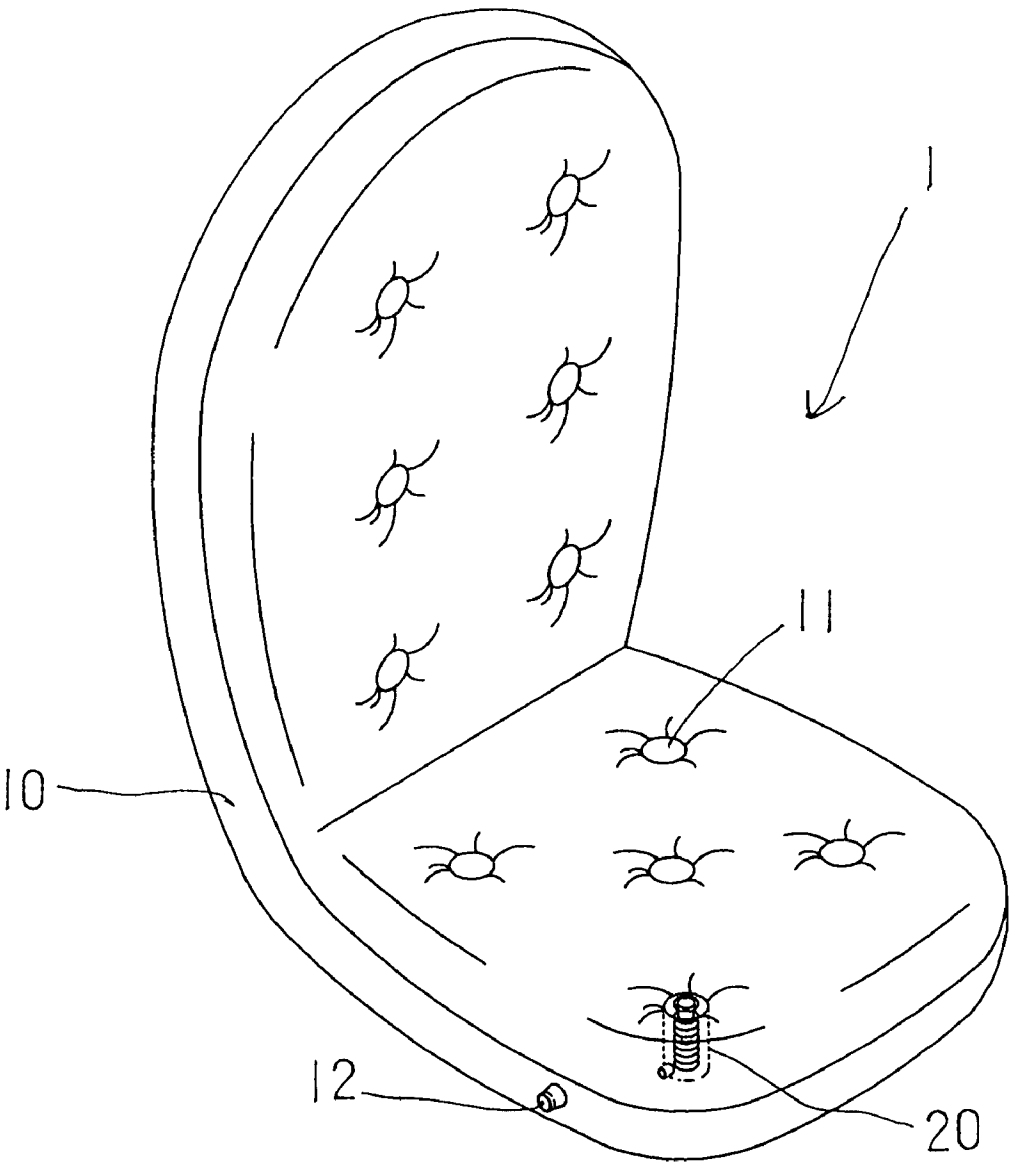
FIG. 6 shows that the hollow body is an inflatable chair.
Figure 7:
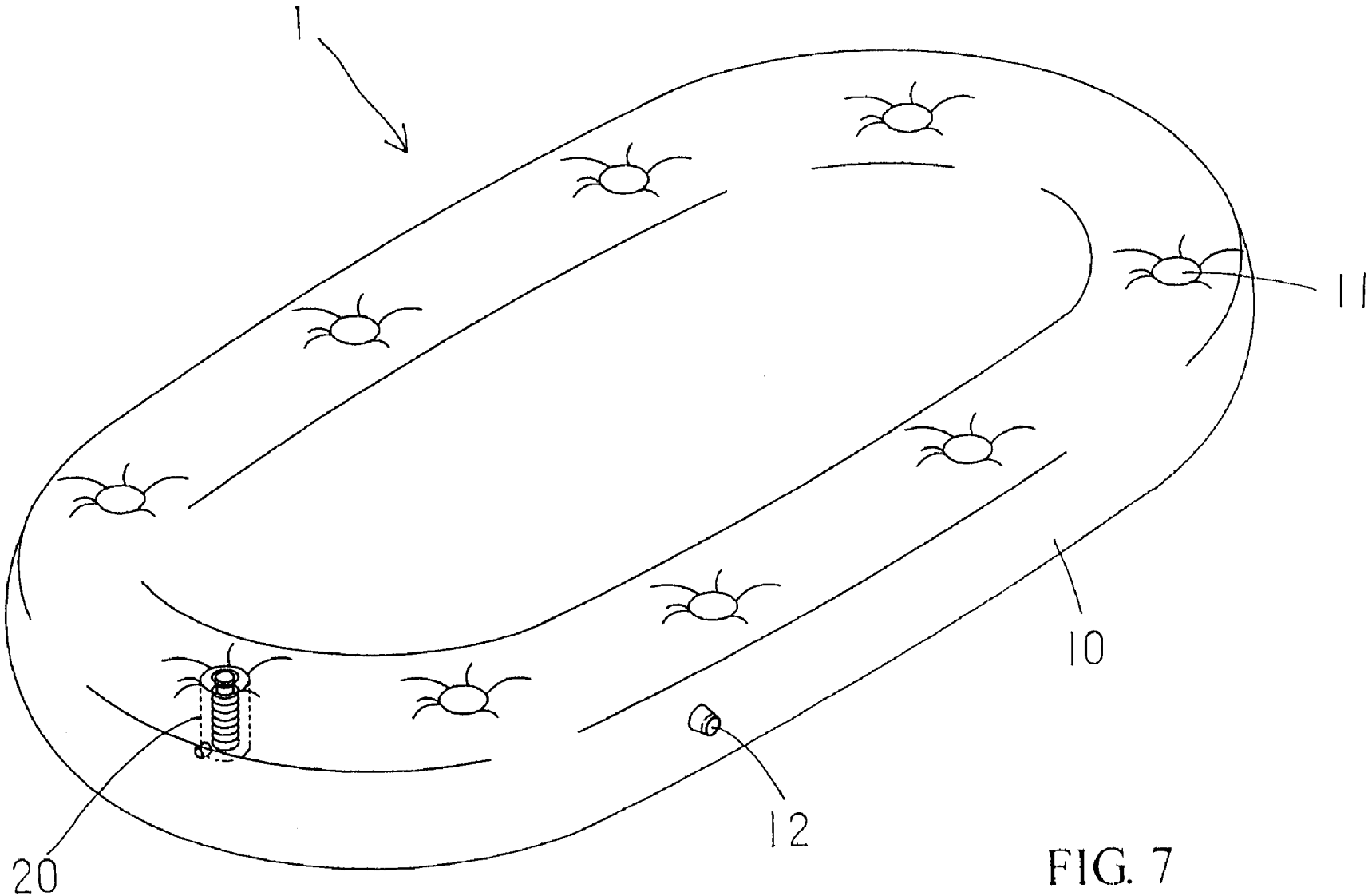
FIG. 7 shows that the hollow body is an inflatable life ring.

The number of the valves 20 can be multiple as desired as shown in FIG. 5, two valves 20 are equipped with the inflatable bed. As shown in FIGS. 6 and 7, the hollow body 10 can also be an inflatable chair and an inflatable life ring. Any known top layer such as a cotton top can be added to the inflatable item to have more comfortable usage.

While we have shown and described the embodiment in accordance with the present invention, it should be clear to those skilled in the art that further embodiments may be made without departing from the scope of the present invention.

What is claimed is:

1. An inflatable item comprising:

a hollow body made from a flexible material and a valve connected to the hollow body, the valve comprising a bladder which has an inlet and an outlet, a tubular insertion engaged with the inlet and having a passage defined therethrough and a bouncing member mounted to the tubular insertion, the bladder being compressible and the bouncing member bouncing the bladder back to its original status, the bouncing member being a spring having an upper end and a lower end, the upper end of the spring being attached to the tubular insertion and the lower end of the spring being unattached and a seal member pivotably connected to the tubular insertion and pivotable between an open position to open the passage of the tubular insertion and a closed position to seal the passage of the tubular insertion, and a cap removably sealing the inlet.

2. The inflatable item as claimed in claim 1, wherein the hollow body includes a plurality of ribs extending from two opposite insides thereof.

3. The inflatable item as claimed in claim 2, wherein a gap is defined between the ribs on the opposite insides of the hollow body.

4. The inflatable item as claimed in claim 1, wherein a release valve is connected to the hollow body.

* * * * *